US011111910B2

(12) United States Patent
Anantharaman et al.

(10) Patent No.: US 11,111,910 B2
(45) **Date of Patent: *Sep. 7, 2021**

(54) ULTRA HIGH VACUUM CRYOGENIC PUMPING APPARATUS WITH NANOSTRUCTURE MATERIAL

(71) Applicant: Taiwan Semiconductor Manufacturing Co., Ltd., Hsin-Chu (TW)

(72) Inventors: Surendra Babu Anantharaman, Hsinchu (TW); Wen-Cheng Yang, Hsinchu (TW); Chung-En Kao, Toufen Township (TW); Victor Y. Lu, Foster City, CA (US); Wei Chin, Pingtung (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 39 days.

This patent is subject to a terminal disclaimer.

(21) Appl. No.: 16/207,470

(22) Filed: Dec. 3, 2018

(65) Prior Publication Data

US 2019/0101110 A1 Apr. 4, 2019

Related U.S. Application Data

(63) Continuation of application No. 14/059,851, filed on Oct. 22, 2013, now Pat. No. 10,145,371.

(51) Int. Cl.
*F04B 37/08* (2006.01)

(52) U.S. Cl.
CPC ..... *F04B 37/08* (2013.01); *F04B 37/085* (2013.01)

(58) Field of Classification Search
CPC ..... F04B 37/08; F04B 37/085; F04B 37/02; C01B 3/0021; B82Y 30/00; Y02E 60/325;
(Continued)

(56) References Cited

U.S. PATENT DOCUMENTS 3,296,773 A 1/1967 Hemstreet
3,364,654 A 1/1968 Westbrock
(Continued)

FOREIGN PATENT DOCUMENTS

CN 1544116 A 11/2004
CN 102327767 A 1/2012
(Continued)

OTHER PUBLICATIONS

J. Hone; "Carbon Nanotubes: Thermal Properties"; Dekker Encyclopedia of Nanoscience and Nanotechnology; 2004; p. 603-610.
(Continued)

*Primary Examiner* — Frantz F Jules
*Assistant Examiner* — Martha Tadesse
(74) *Attorney, Agent, or Firm* — Eschweiler & Potashnik, LLC

(57) ABSTRACT

Cryogenic pump apparatuses include nanostructure material to achieve an ultra-high vacuum level. The nanostructure material can be mixed with either an adsorbent material or a fixed glue layer which is utilized to fix the adsorbent material. The nanostructure material's good thermal conductivity and adsorption properties help to lower working temperature and extend regeneration cycle of the cryogenic pumps.

20 Claims, 5 Drawing Sheets

(58) Field of Classification Search
CPC ..... Y10S 417/901; B01D 8/00; F28F 13/18; B01J 20/205; B01J 20/28007
See application file for complete search history.

(56) References Cited

U.S. PATENT DOCUMENTS

| | | | | |
|---|---|---|---|---|
| 4,546,613 | A | 10/1985 | Eacobacci et al. | |
| 4,791,791 | A | 12/1988 | Flegal et al. | |
| 4,873,833 | A | 10/1989 | Pfeiffer et al. | |
| 5,000,007 | A | 3/1991 | Haefner | |
| 5,001,903 | A | 3/1991 | Lessard et al. | |
| 5,365,743 | A * | 11/1994 | Nagao | F04B 37/08 62/47.1 |
| 5,450,729 | A * | 9/1995 | Hilton | F04B 37/08 62/55.5 |
| 6,122,920 | A | 9/2000 | Hill et al. | |
| 6,155,059 | A | 12/2000 | Matte et al. | |
| 6,330,801 | B1 | 12/2001 | Whelan et al. | |
| 6,545,610 | B2 | 4/2003 | Kurtz et al. | |
| 6,591,617 | B2 | 7/2003 | Wolfe et al. | |
| 7,313,922 | B2 | 1/2008 | Bartlett et al. | |
| 8,261,559 | B2 * | 9/2012 | Tanaka | F04B 37/08 62/55.5 |
| 8,545,610 | B2 | 10/2013 | Makino et al. | |
| 8,959,932 | B2 * | 2/2015 | Matsubara | F04B 37/08 62/55.5 |
| 2007/0092437 | A1 * | 4/2007 | Kwon | C01B 3/0021 423/658.2 |
| 2009/0165469 | A1 | 7/2009 | Matsubara | |
| 2010/0000235 | A1 * | 1/2010 | Tanaka | F04B 37/08 62/55.5 |
| 2010/0034669 | A1 | 2/2010 | Imholt | |
| 2011/0174079 | A1 | 7/2011 | Manohara et al. | |

FOREIGN PATENT DOCUMENTS

| | | | | |
|---|---|---|---|---|
| CN | 203175786 | U | | 9/2013 |
| JP | 2006043603 | A | * | 2/2006 |
| JP | 2006101031 | A | | 4/2006 |
| JP | 2007226297 | A | | 9/2007 |
| KR | 20110000043 | A | | 1/2011 |
| WO | 9400212 | A1 | | 1/1994 |
| WO | 2010034634 | A1 | | 4/2010 |

OTHER PUBLICATIONS

Peng-Xiang Hou, et al.; "Hydrogen Adsorption/Desorption Behavior of Multi-Walled Carbon Nanotubes with Different Diameters"; Carbon 41; 2003; p. 2471-2476.
Fanxing Li, et al.; "Characterization of Single-Wall Carbon Nanotubes by N2 Adsorption"; Carbon 42, 2004, p. 2375-2383.
D. Martins, et al.; "Low Temperature Adsorption Versus Pore Size in Activated Carbons"; Cryocoolers 16, 2011; p. 567-573.
F. Xu, et al.; "Hydrogen Cryosorption on Multi Walled Carbon Nanotubes"; Proceedings of EPAC08, Genoa, Italy; p. 2515-2517.
"Cryopumps, Cryogenics"; Excerpt from the Oerlikon Leybold Vacuum Full Line Catalog; Product Section C12, Edition 2010; p. 1-58.
Non-Final Office Action dated Apr. 12, 2016 for U.S. Appl. No. 14/059,851.
Final Office Action dated Oct. 25, 2016 for U.S. Appl. No. 14/059,851.
Non-Final Office Action dated Sep. 7, 2017 for U.S. Appl. No. 14/059,851.
Final Office Action dated Feb. 27, 2018 for U.S. Appl. No. 14/059,851.
Notice of Allowance dated Jul. 18, 2018 for U.S. Appl. No. 14/059,851.

* cited by examiner

FIG. 2
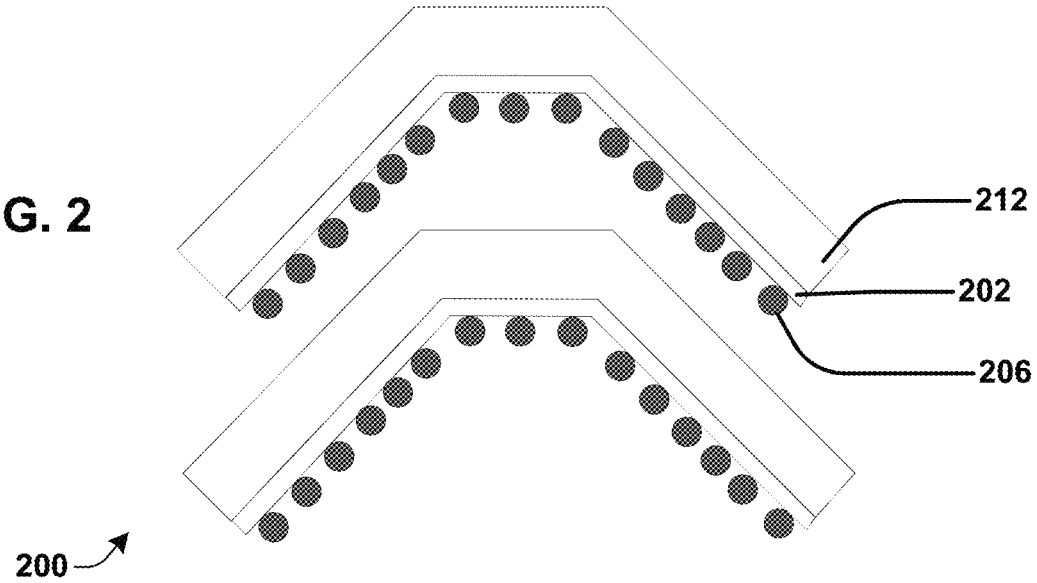
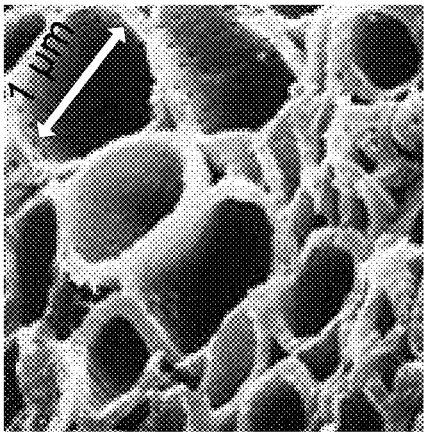
FIG. 3A
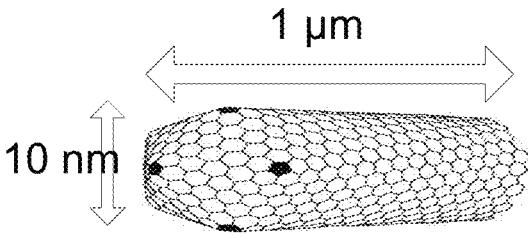
FIG. 3B

ULTRA HIGH VACUUM CRYOGENIC PUMPING APPARATUS WITH NANOSTRUCTURE MATERIAL

REFERENCE TO RELATED APPLICATION

This Application is a Continuation of U.S. application Ser. No. 14/059,851 filed on Oct. 22, 2013, the contents of which are hereby incorporated by reference in their entirety.

BACKGROUND

Vacuum systems are widely used in scientific research and industry. Among many important technology fields that need high vacuum system is the semiconductor manufacturing field. Frequently the performance of devices highly depends on the pressure and impurities present in a vacuum system. Residual gases and/or other impurities in the growth environment could be a significant source of contamination of the product.

Ultra high vacuum regime is the vacuum regime characterized by pressure lower than $10^{-9}$ Torr, and is not trivial to achieve. Though pumps can continue to remove particles from a vacuum chamber in an attempt to decrease the pressure in the vacuum chamber, gases enter the vacuum chamber by surface desorption from the chamber's walls or permeation through the walls. Especially when pressure is low, the pressure difference between the inside of the chamber and the ambient environment outside the vacuum chamber makes permeation more serious.

Cryogenic pumps are one type of vacuum device that can be used to attempt to achieve ultra-high vacuum conditions by removing gases from a sealed vacuum chamber at low temperature. Cryogenic pumps trap particles by condensing them on a cold surface.

BRIEF DESCRIPTION OF THE DRAWINGS

FIG. 2 shows a cross-sectional view of part of a cryogenic pumping structure according to some embodiments.

FIGS. 3A-3B shows an exemplary structural representation of an active charcoal material and a nanostructure material.

DETAILED DESCRIPTION

Figure 1:
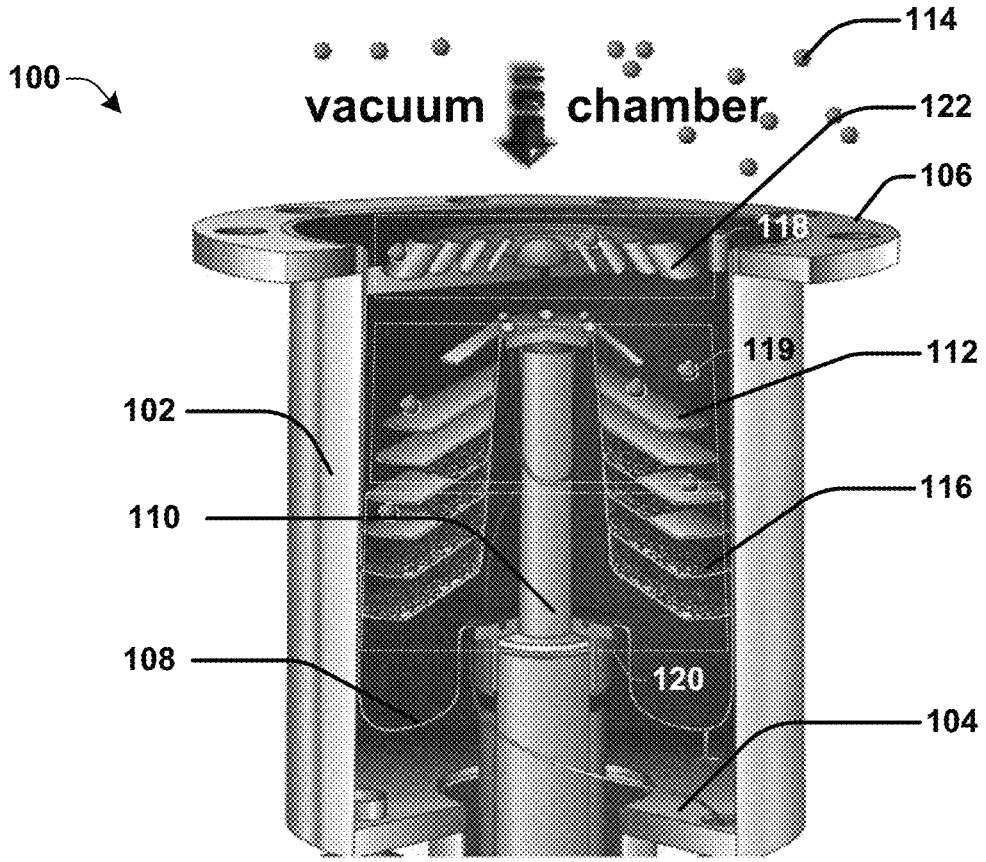
FIG. 1 shows a cutaway view of a cryogenic pump with an exemplary adsorbent layer on a cryogenic blade array.

The description herein is made with reference to the drawings, wherein like reference numerals are generally utilized to refer to like elements throughout, and wherein the various structures are not necessarily drawn to scale. In the following description, for purposes of explanation, numerous specific details are set forth in order to facilitate understanding. It will be appreciated that the details of the figures are not intended to limit the disclosure, but rather are non-limiting embodiments. For example, it may be evident, however, to one of ordinary skill in the art, that one or more aspects described herein may be practiced with a lesser degree of these specific details. In other instances, known structures and devices are shown in block diagram form to facilitate understanding.

In general, the present disclosure is related to an optimized cryogenic pump in order to achieve ultra high vacuum level and longer regeneration cycles. More particularly, the present disclosure is about introducing a nanostructure material with good absorption characteristics to attain more absorption of multiple particles. Further, in some embodiments, the nanostructure material can be part of adsorbents, in some alternative embodiments, the nanostructure material can be mixed with a fixed glue layer so that its large thermal conductivity would help to lower working temperature and further improve condensation.

FIG. 1 shows a cutaway view of an exemplary cryogenic pump 100 in accordance with some embodiments. The cryogenic pump 100 comprises a canister 102 with one closed end 104 and the other end terminating in a flange 106. The flange 106 is sealed to a port of a vacuum chamber (not shown). A thermal shield 108 helps to prevent thermal conduction between the sealed vacuum chamber and the outer higher temperature environment. A cold header 110 cools a cryogenic blade array 112 which is linked thermally to the cold header.

Some cryogenic pumps have multiple stages at various low temperatures. For example, FIG. 1 illustrates a pump with a first (e.g., outer) stage 118, a second (e.g., middle) stage 119, and a third (e.g., inner) stage 120. The outer stage 118, which includes an inlet array 122, condenses gases with high boiling points such as water ($H_2O$), oil, and carbon oxide ($CO_2$) from the vacuum chamber, and can operate for example at temperatures between 50 K and 100 K. The second stage 119, which includes a first part of the cryogenic blade array 112, condenses gases with relatively low boiling points such as nitrogen ($N_2$), oxygen ($O_2$) and any remaining $CO_2$, and can be used at temperatures ranging from approximately 10K to approximately 40K. The inner stage 120, which includes a second part of the cryogenic blade array 112 with an adsorbent layer 116, traps gases with lower boiling points and small molecular-weight such as helium (He), neon (Ne), and hydrogen ($H_2$), and can be used at temperatures ranging from approximately 4K to approximately 20K.

The cryogenic pump 100 can be utilized in fields that require a high vacuum level. For example, in semiconductor industry, the cryogenic pump 100 can be utilized in systems such as for Physical Vapor Deposition (PVD), Molecular Beam Epitaxy (MBE) or implanter chambers. The cryogenic pump 100 can also be used in conjunction with a mechanical pump, which may be referred to in some instances as a roughing pump. The roughing pump and cryogenic pump can collectively establish a high vacuum or ultra high vacuum for semiconductor processing tools.

During operation, the first stage 118, second stage 119, and third stage 120 are cooled by compressed helium, liquid nitrogen, or a built-in cryo-cooler. Water molecules and other molecules with higher boiling points are condensed on the inlet array 120, while gas molecules with lower boiling points within the sealed vacuum chamber condense on a surface of the cryogenic blade array 112 and the adsorbent 116 when temperature is low enough. If the surface becomes saturated with condensate, few additional particles will be able to condense on the surface. To regenerate condensation ability of the cryogenic pump, regeneration is applied by heating the blade array 116 to a temperature allowed by the materials of the pump, to thereby outgas the condensed particles and allow condensation to restart. Time needed for such a regeneration cycle is called cryo lifetime.

To provider better condensation and regeneration ability, some embodiments of the present disclosure utilize nanostructures on the surfaces of the blade array 112. For example, in some embodiments, single walled carbon nanotubes or multi-walled carbon nanotubes are formed on the surfaces of the blade array to improve condensation and regeneration. These carbon nanotubes provide high activation energy for adsorption and de-sorption and high thermal conductivity, which fosters efficient condensation and regeneration. In some embodiments, the nanostructures can be formed on blades of only the third stage 120 to help achieve ultra-low vacuum, but in other embodiments the nanostructures can be formed on blades of the first and/or second stages 118, 119 as well.

To bond these nanostructures to surfaces of the blade array 112, a fixed glue layer is applied on the cryogenic blade array to fix the adsorbent layer 116, which absorbs gas molecules. A nanostructure material is then mixed with either the fixed glue layer or the adsorbent layer to improve absorption and extend cryo lifetime. In some embodiments, the adsorbent layer includes porous activated charcoal. Activation energy for adsorption and desorption of gases with the nanostructure material is lower than the activation energy with activated charcoal material alone. The nanostructure material saturates first before the activated charcoal material starts absorbing particles. Further, the nanostructure material provides desorption at lower temperature than the activated charcoal material which makes it quicker and easier to get complete desorption.

Defects of the nanostructure material can occur in the form of atomic vacancies, disordering, or impurities. The defects can be of pentagons and hexagons for carbon nanotube. There are also some carbon islands consisting of carbon nanotube clusters. These defects and carbon islands act as bonding sites to enhance adsorption of particles in the cryogenic pumps. These particles as an example include $H_2O$, $O_2$, $CO_2$, $H_2$, $N_2$, or He. Presence of the defects helps in forming bonds with molecules through chemisorption, and helps in forming bonds with atomic particles through physisorption, both of which help to achieve lower vacuum levels. Because carbon nanotubes are an allotropic form of graphite, in some embodiments, the carbon nanotubes can have a high defect density, for example $I_d/I_g>0.2$, wherein $I_d$ represents an intensity of crystallographic carbon nanotube defects and $I_g$ represents the intensity of crystallographic graphite when the nanostructure material is analyzed using Raman spectroscopy. Thus, $I_d/I_g$ represents an amount of defects present in the carbon nanotube material. The inventors have appreciated that higher defect densities improve absorption for cryogenic pumps, thereby promoting lower vacuum levels.

FIG. 2 shows a cross-view schematic representation of partial of cryogenic pumping structure 200 according to some embodiments. In these embodiments, a fixed glue layer 202 is on a cryogenic blade 212 and an adsorbent layer 206 includes an activated charcoal material and a carbon nanotube (CNT) material. The fixed glue layer 202 may also include a CNT material. In some embodiments, the thermal conductivity of the glue material at 10 K, 20 K, 30 K and 40 K is about 0.15 W/mK, 0.22 W/mK, 0.26 W/mK, and 0.29 W/mK, respectively. This thermal conductivity of the glue layer is increased when the glue layer is mixed with high thermal conductivity (~3000 W/mK, for multi-walled CNT's) nanomaterials like CNT. CNT structures can include single walled carbon atoms or multi-walled carbon atoms, with any such structure possibly having a high defect density at an enclosed end thereof. In some embodiments, the nanostructures of the CNT material have an outer diameter ranging from about 10 nm to about 60 nm and an inner diameter ranging from about 2 nm to about 5 nm.

In some instances, it is advantageous to have adsorbent layer 206 arranged on a lower surface of the blade 212 with the glue layer 202 arranged between the blade and adsorbent layer 206. This is because when the glue layer 202 and adsorbent layer 206 are on the lower blade surface 212, the condensation of molecules tends to leave the pores in the adsorbent layer 206 open. In contrast, if the adsorbent layer 206 is on the top side of the blade 212, pores in the adsorbent layer 206 can become more easily blocked by condensation of other gases, and the adsorbent layer 206 is less able to trap gases like $H_2$, He. Nonetheless, in general, the adsorbent layer 206 could be arranged on the top surface or bottom surface of the blade 212, and/or on both the top and bottom surfaces of the blade, depending on the precise implementation.

FIG. 3(*a*) shows an exemplary structural representation of the activated charcoal material and FIG. 3(*b*) shows an exemplary structural representation of the carbon nanotube, where pentagon defects allow an end of the carbon nanotube to be enclosed. In the example, pores of the active charcoal have a dimension about 1 μm and the carbon nanotube is single wall with diameter about 10 nm and length about 1 μm. The CNT material is mixed into the pores of the activated charcoal by ball milling method.

Figure 4:
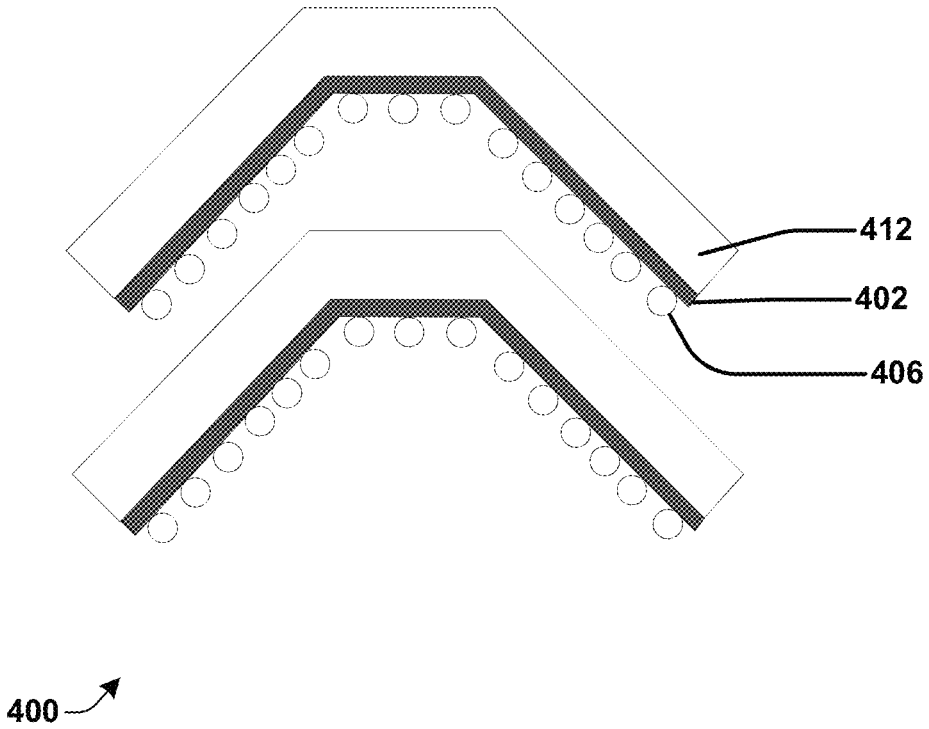
FIG. 4 shows a cross-sectional view of part of a cryogenic pumping structure according to some alternative embodiments.

FIG. 4 shows a cross-view schematic representation of partial of cryogenic pumping structure according to some alternative embodiments. In these embodiments, an adsorbent layer 406 includes an activated charcoal material and a fixed glue layer 402 includes a carbon nanotube (CNT) material. The carbon nanotube material has a large thermal conductivity. The fixed glue layer 402 comprising the CNT material has a thermal conductivity about 1000 times larger than that of a fixed glue layer not comprising the CNT. Temperature of a cryogenic blade 412 when working is lowered. For example, a working temperature can be lowered to about 8 kelvin.

Figure 5:
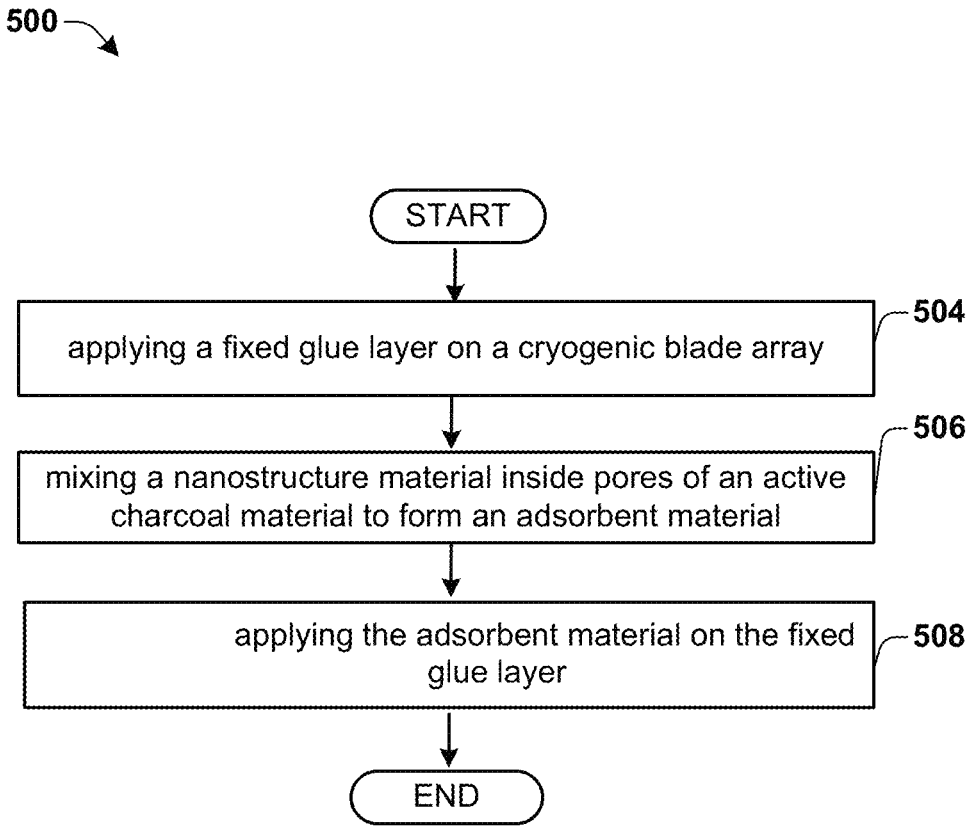
FIG. 5 shows a flow diagram of some embodiments of achieving ultra high vacuum levels for cryogenic pumps.

FIG. 5 shows a flow diagram 500 of some embodiments of a method for achieving ultra high vacuum levels for cryogenic pumps. At 504, a fixed glue layer is applied on a cryogenic blade array. At 506, a nanostructure material is mixed inside pores of an active charcoal material in order to form an adsorbent material. The nanostructure material can be carbon nanotubes, such as single-wall carbon nanotubes or multi-walled carbon nanotubes. At 508, the adsorbent material is applied onto the fixed glue layer. Some crystallographic defects of nanostructure material help to form bonds with gases as bonding site. A carbon nanotube material with defect density (ratio of intensity of defects $I_d$ to intensity of normal graphite phase $I_g$, $I_d/I_g$) larger than 0.2 has absorption ability about 10 times higher than an active charcoal material. By increasing defect density, absorption is improved.

Figure 6:
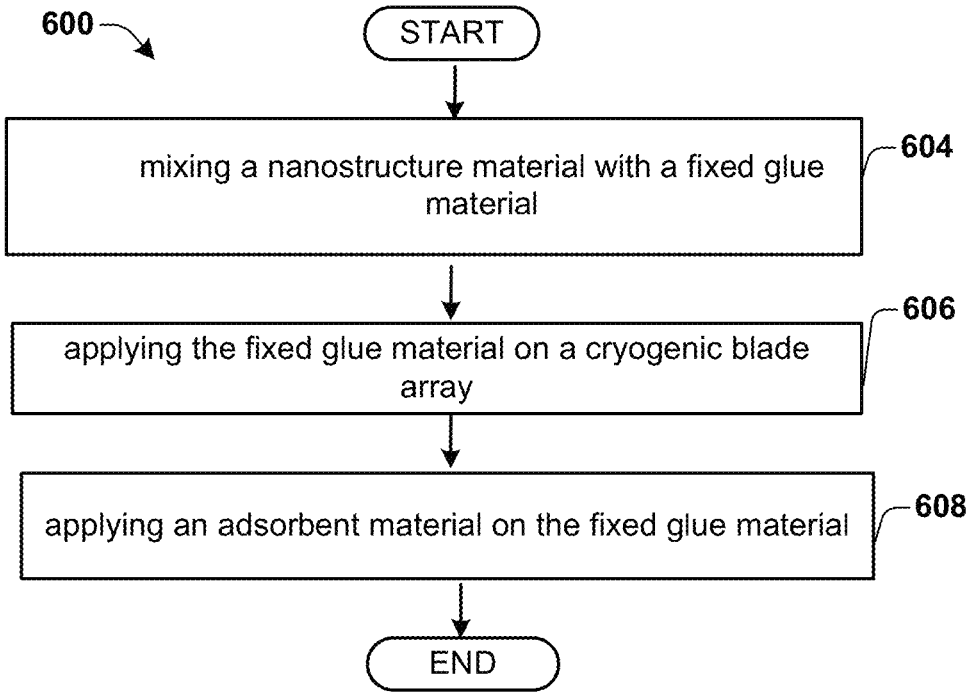
FIG. 6 shows a flow diagram of some alternative embodiments of achieving ultra high vacuum levels for cryogenic pumps.

FIG. 6 shows a flow diagram 600 of some alternative embodiments of a method for achieving ultra high vacuum levels for cryogenic pumps. At 604, a nanostructure material is mixed with a fixed glue material. The nanostructure material has a large thermal conductivity. At 606, the fixed glue material is applied on a cryogenic blade array. At 608, an adsorbent material is applied onto the fixed glue layer.

Thus, it will be appreciated that some embodiments relate to a cryogenic pumping apparatus comprising a canister having a flange to be coupled to a vacuum chamber. A cryogenic blade array is arranged within the canister. The cryogenic blade array includes a first plurality of blades closer to the vacuum chamber and a second plurality of blades further from the vacuum chamber. A fixed glue layer is on a blade of the cryogenic blade array. An adsorbent material is on the fixed glue layer, at least one of the adsorbent material or the fixed glue layer including a carbon nanotube material. The carbon nanotube material is arranged on the second plurality of blades and absent from the first plurality of blades.

Other embodiments relate to a method of achieving ultra high vacuum levels for cryogenic pumps. In this method, a fixed glue layer is applied on a blade of a cryogenic blade array. An adsorbent material is then applied on the fixed glue layer. The fixed glue layer and the adsorbent material are formed on both upper and lower surfaces of the blade of the cryogenic blade array.

Still other embodiments relate to a multi-stage cryogenic pumping apparatus. This cryogenic pumping apparatus includes a canister having a flange to be coupled to a vacuum chamber. A first stage within the canister is in fluid communication with the vacuum chamber, and includes an inlet array to condense gases having boiling points within a first temperature range. A second stage within the canister is also in fluid communication with the vacuum chamber, but is fluidly downstream of the first stage relative to the vacuum chamber. The second stage includes a cold header to cool a cryogenic blade array in the second stage. The cryogenic blade array includes a carbon nanotube material mixed with a fixed glue layer to trap gases having boiling points within a second temperature range, which is less than the first temperature range. A thermal conductivity of the fixed glue layer mixed with the carbon nanotube material is larger than that of the fixed glue layer not mixed with the carbon nanotube material.

It will be appreciated that equivalent alterations and/or modifications may occur to those skilled in the art based upon a reading and/or understanding of the specification and annexed drawings. The disclosure herein includes all such modifications and alterations and is generally not intended to be limited thereby. For example, although the figures provided herein, are illustrated and described to have a particular working temperature, it will be appreciated that alternative temperatures may be utilized as will be appreciated by one of ordinary skill in the art.

In addition, while a particular feature or aspect may have been disclosed with respect to only one of several implementations, such feature or aspect may be combined with one or more other features and/or aspects of other implementations as may be desired. Furthermore, to the extent that the terms "includes", "having", "has", "with", and/or variants thereof are used herein, such terms are intended to be inclusive in meaning—like "comprising". Also, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

What is claimed is:

1. A cryogenic pumping apparatus comprising: a canister having a flange to be coupled to a vacuum chamber; a cryogenic blade array arranged within the canister, the cryogenic blade array including a first plurality of repeated blades one vertically stacked over another and closer to the vacuum chamber and a second plurality of repeated blades one vertically stacked over another and further from the vacuum chamber; a fixed glue layer on the second plurality of repeated blades of the cryogenic blade array; and an adsorbent material on the fixed glue layer, at least one of the adsorbent material or the fixed glue layer including a carbon nanotube material; wherein the carbon nanotube material is arranged on the second plurality of repeated blades and absent from the first plurality of repeated blades.

2. The cryogenic pumping apparatus of claim 1, wherein the adsorbent material comprises an active charcoal material with the carbon nanotube material mixing inside pores therein.

3. The cryogenic pumping apparatus of claim 2, wherein the fixed glue layer comprises the carbon nanotube material.

4. The cryogenic pumping apparatus of claim 1, wherein the carbon nanotube material is mixed with the fixed glue layer.

5. The cryogenic pumping apparatus of claim 4, wherein the adsorbent material comprises an activated charcoal material.

6. The cryogenic pumping apparatus of claim 4, wherein a thermal conductivity of the fixed glue layer is larger than that of a second fixed glue layer not being mixed with the carbon nanotube material.

7. The cryogenic pumping apparatus of claim 4, wherein a working temperature of the cryogenic blade array is approximately 8 kelvin.

8. The cryogenic pumping apparatus of claim 1, wherein the carbon nanotube material includes single-walled carbon nanotubes.

9. The cryogenic pumping apparatus of claim 1, wherein the carbon nanotube material includes multi-walled carbon nanotubes.

10. The cryogenic pumping apparatus of claim 1, wherein the carbon nanotube material has crystallographic defects.

11. The cryogenic pumping apparatus of claim 10, wherein the crystallographic defects are bonding sites for particles to be absorbed by the carbon nanotube material.

12. The cryogenic pumping apparatus of claim 11, wherein the particles comprise $H_2O$, $O_2$, $CO_2$, $H_2$, $N_2$, or He.

13. The cryogenic pumping apparatus of claim 1, wherein the vacuum chamber is utilized for Physical Vapor Deposition (PVD), Molecular Beam Epitaxy (MBE), or implanter chambers.

14. A cryogenic pumping apparatus, comprising:

a canister having a flange to be coupled to a vacuum chamber;

a cryogenic blade array arranged within the canister;

a fixed glue layer disposed on a blade of the cryogenic blade array; and an adsorbent material disposed on the fixed glue layer, wherein the fixed glue layer and the adsorbent material are formed on both upper and lower surfaces of the blade of the cryogenic blade array; and wherein the adsorbent material includes a nanostructure material mixed inside pores of an active charcoal material.

15. The cryogenic pumping apparatus of claim 14, wherein the nanostructure material is configured to absorb particles and be saturated before the active charcoal material starts absorbing more particles.

16. The cryogenic pumping apparatus of claim 14, wherein the nanostructure material has crystallographic defects.

17. The cryogenic pumping apparatus of claim 16, wherein the crystallographic defects of the nanostructure material form bonds with molecules through chemisorption.

18. The cryogenic pumping apparatus of claim 16, wherein the crystallographic defects of the nanostructure material form bonds with atomic species through physisorption.

19. A cryogenic pumping apparatus, comprising:

a canister having a flange to be coupled to a vacuum chamber;

a first stage within the canister, the first stage to be in fluid communication with the vacuum chamber and including an inlet array to condense gases having boiling points within a first temperature range; and a second stage within the canister, the second stage to be in fluid communication with the vacuum chamber but fluidly downstream of the first stage relative to the vacuum chamber, the second stage including a cold header to cool a cryogenic blade array in the second stage, the cryogenic blade array including a fixed glue layer disposed on a blade of the cryogenic blade array and an adsorbent material disposed on the fixed glue layer, wherein a carbon nanotube material is mixed with the fixed glue layer to trap gases having boiling points within a second temperature range that is less than the first temperature range;

wherein a thermal conductivity of the fixed glue layer mixed with the carbon nanotube material is larger than that of the fixed glue layer not mixed with the carbon nanotube material.

20. The cryogenic pumping apparatus of claim 1, further comprising an inlet array disposed within the canister above the cryogenic blade array.

* * * * *